US007477274B2

(12) United States Patent
Van Brocklin et al.

(10) Patent No.: US 7,477,274 B2
(45) Date of Patent: Jan. 13, 2009

(54) THERMALLY SENSITIVE MEDIUM AND METHODS AND SYSTEMS FOR FORMING AN IMAGE ON A THERMALLY SENSITIVE MEDIUM

(75) Inventors: Andrew L. Van Brocklin, Corvallis, OR (US); Jayprakash C. Bhatt, Corvallis, OR (US); Jeffrey M. Valley, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 340 days.

(21) Appl. No.: 11/021,577

(22) Filed: Dec. 22, 2004

(65) Prior Publication Data

US 2006/0132585 A1 Jun. 22, 2006

(51) Int. Cl.
*B41J 2/32* (2006.01)

(52) U.S. Cl. ..... 347/172; 347/221

(58) Field of Classification Search ..... 347/175, 347/224, 225, 232, 221, 172
See application file for complete search history.

(56) References Cited

U.S. PATENT DOCUMENTS

| | | | | |
|---|---|---|---|---|
| 5,200,947 | A * | 4/1993 | Satake et al. | 369/275.1 |
| 6,236,421 | B1 * | 5/2001 | Imai | 347/172 |
| 6,278,472 | B1 * | 8/2001 | Sasaki et al. | 347/175 |
| 6,445,464 | B1 | 9/2002 | Kishimoto | |
| 6,503,695 | B1 | 1/2003 | Miyazawa et al. | |
| 6,509,131 | B2 | 1/2003 | Hare et al. | |
| 6,552,822 | B1 | 4/2003 | Kishimoto | |
| 6,660,689 | B2 | 12/2003 | Serizawa et al. | |
| 6,786,994 | B2 | 9/2004 | Williams et al. | |
| 2003/0161224 | A1 | 8/2003 | Anderson et al. | |
| 2003/0179679 | A1 | 9/2003 | Morishima | |
| 2004/0169717 | A1 | 9/2004 | Bronson | |
| 2004/0214093 | A1 * | 10/2004 | Miyazaki | 430/1 |
| 2006/0001849 | A1 * | 1/2006 | Ray et al. | 355/50 |
| 2006/0092792 | A1 * | 5/2006 | Hanks et al. | 369/47.53 |

FOREIGN PATENT DOCUMENTS

| | | | |
|---|---|---|---|
| EP | 1 081 695 A | | 3/2001 |
| EP | 1 398 169 A | | 3/2004 |
| JP | 58094494 | * | 6/1983 |
| JP | 58209594 | * | 12/1983 |
| WO | WO 2005/026839 A | | 3/2005 |
| WO | WO 2005/120849 A | | 12/2005 |
| WO | WO 2006-038996 A | | 4/2006 |

* cited by examiner

*Primary Examiner*—Huan H Tran

(57) ABSTRACT

A thermally sensitive medium includes at least one layer of temperature-activated dye, and antenna molecules disposed in the layer of temperature-activated dye for converting radiant energy into thermal energy. A system for forming an image on a thermally sensitive medium includes a radiant energy source for selectively heating portions of the thermally sensitive medium to activate temperature-activated dyes of the medium. A method of forming an image on a thermally sensitive medium having multiple layers of temperature-activated dyes is performed by selectively heating portions of each of the layers of temperature-activated dyes with a light source to form the image.

37 Claims, 4 Drawing Sheets

Fig. 3
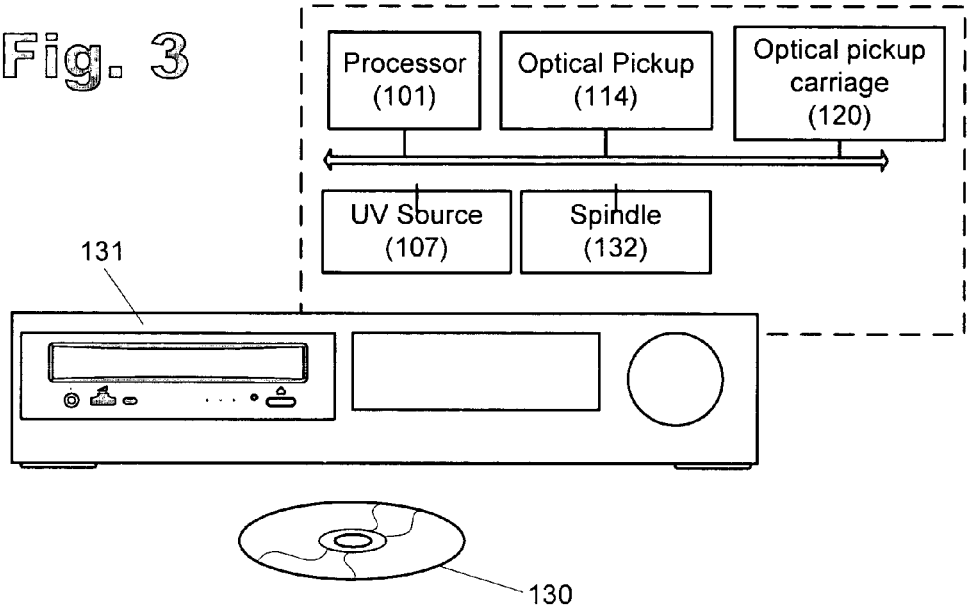
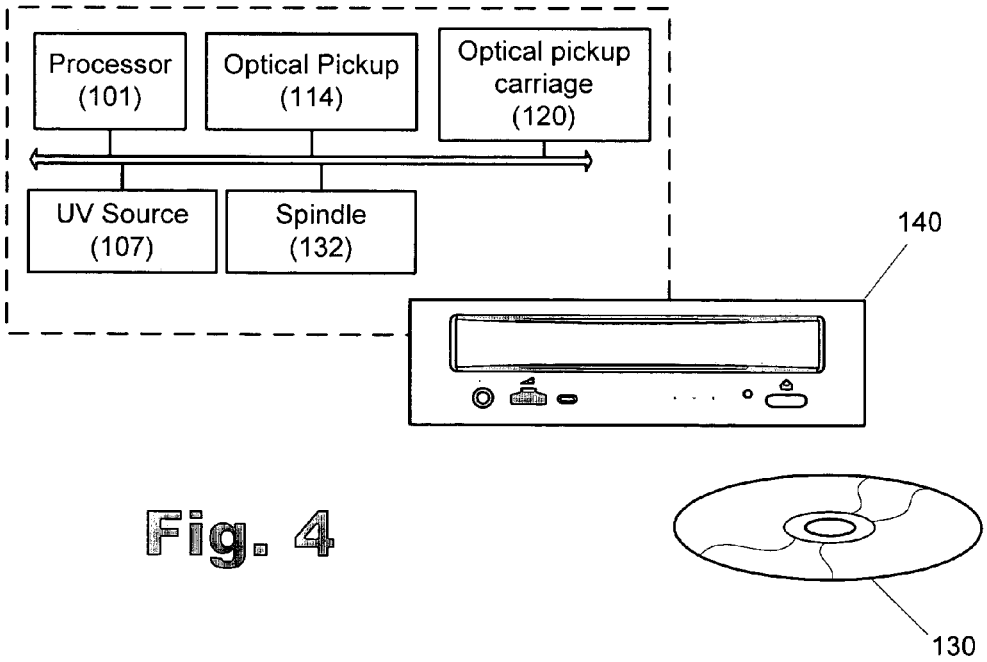
Fig. 4

THERMALLY SENSITIVE MEDIUM AND METHODS AND SYSTEMS FOR FORMING AN IMAGE ON A THERMALLY SENSITIVE MEDIUM

BACKGROUND

Many devices have been developed for printing or generating images on a medium. Some such devices, inkjet printers for example, operate by selectively ejecting ink onto the print medium to form the desired image. Other devices, such as laser printers, form an image using toner on an imaging drum and then transfer the image to a print medium. Photographic processes allow light to cause a chemical change in photographic film to capture an image.

A relatively new thermally sensitive process is known as thermo-autochrome printing. Thermo-autochrome printing is more akin to photography than printing, and has emerged recently in printers marketed as companion devices for use with a digital camera.

Thermo-autochrome paper contains three color-forming layers—cyan, magenta and yellow—that each include components that are released and combined by heat to form a dye or pigment of a desired color. In other words, each color-forming layer is sensitive to a particular temperature and displays its corresponding color when heated to that temperature. Of these colorants, yellow has the lowest temperature sensitivity, then magenta, followed by cyan. Specific portions of the color-forming layer can be heated to create the corresponding color in only the heated areas.

A typical thermo-autochrome printer is equipped with a thermal head that selectively heats portions of the paper to activate the dye or pigment. The thermal head typically has heating resistors that are brought into close thermal contact with the thermo-autochrome paper to selectively heat the temperature-sensitive layers.

SUMMARY

A thermally sensitive medium includes at least one layer of temperature-activated dye, and antenna molecules disposed in the layer of temperature-activated dye for converting radiant energy into thermal energy. A system for forming an image on a thermally sensitive medium includes a radiant energy source for selectively heating portions of the thermally sensitive medium to activate temperature-activated dyes of the medium. A method of forming an image on a thermally sensitive medium having multiple layers of temperature-activated dyes is performed by selectively heating portions of each of the layers of temperature-activated dyes with a light source to form the image.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

FIG. 3 is an illustration of an optical disc player/writer incorporating the system shown in FIG. 1 according to principles described herein.

FIG. 4 is an illustration of an optical disc drive reader/writer incorporating the system shown in FIG. 1 according to principles described herein.

Throughout the drawings, identical reference numbers designate similar, but not necessarily identical, elements.

DETAILED DESCRIPTION

The present specification describes a thermally sensitive medium and a system for forming or printing images on that medium. The systems and methods described use light to selectively heat the thermally sensitive medium so as to activate the desired color or color combination of dye for each pixel of the image being formed.

Figure 1:
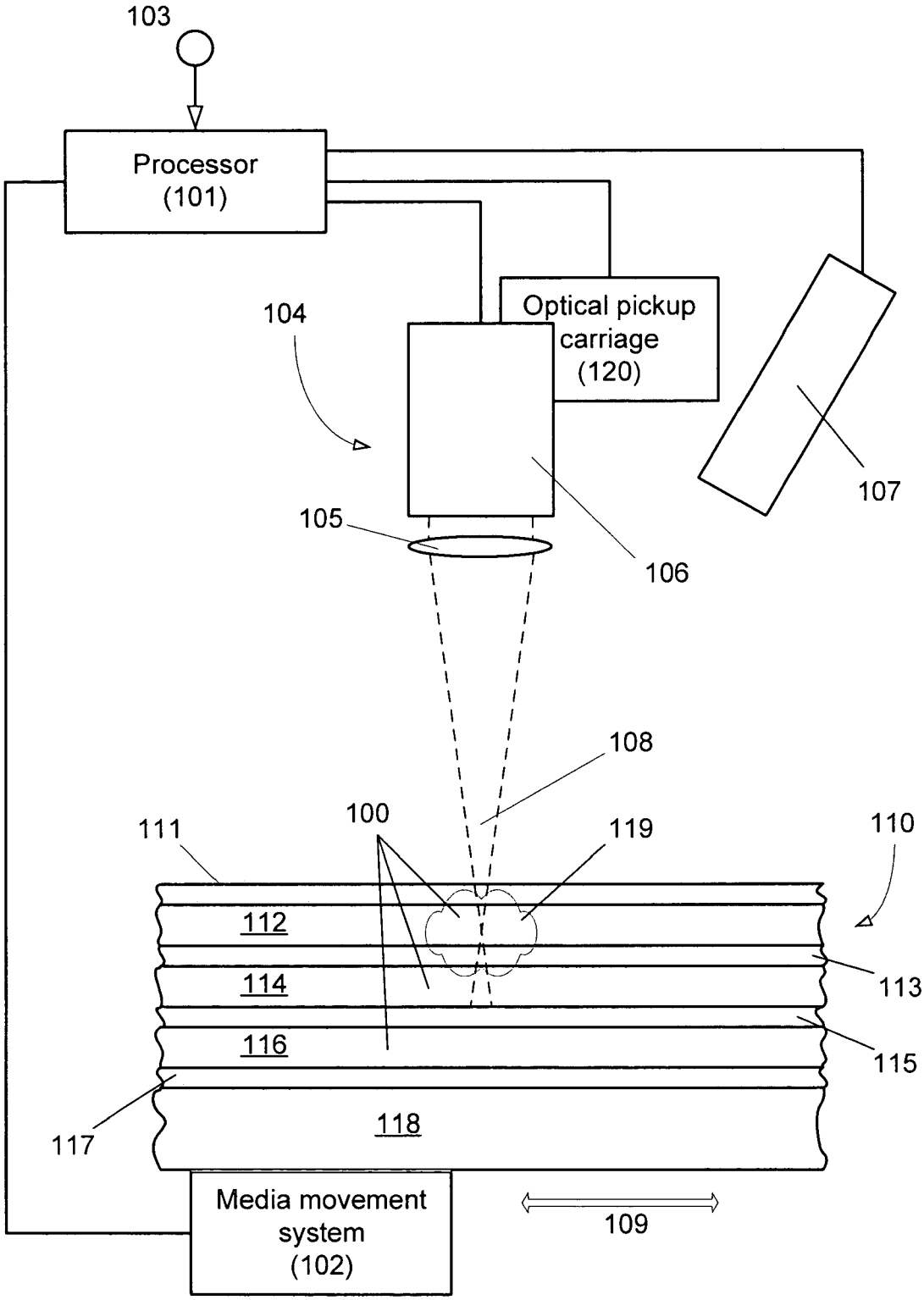
FIG. 1 is an illustration of an exemplary system for producing a color image on a medium according to principles described herein.

FIG. 1 is an illustration of an exemplary system for producing a color image on a medium according to principles described herein. As shown in FIG. 1, the thermally sensitive medium (110) described comprises three color-forming layers (112, 114, 116) on a substrate (118). The substrate (118) may be any of a wide variety of substrates including, but not limited to, paper, plastic, vinyl, a compact disc, a digital video (or versatile) disc (DVD), etc. Each color-forming layer (112, 114, 116) includes temperature-sensitive components that form a dye or pigment of a specific color when heated beyond a specific temperature.

Disposed on the substrate (118) are, from top to bottom, an overcoat layer (111), a yellow color-forming layer (112), a spacer layer (113), a magenta color-forming layer (114), a second spacer layer (115) and a cyan color-forming layer (116). Each of the layers will now be described in further detail.

The overcoat layer (111) protects the underlying layers and provides the upper surface for the medium (110). Below the overcoat layer (111) is the yellow color-forming layer (112). The material of this layer will react and combine to form a yellow colored dye or pigment when heated to a particular temperature.

A spacer layer (113) is disposed between the yellow color-forming layer (112) and the underlying magenta color-forming layer (114). The magenta color-forming layer (114) is also temperature-sensitive and will take on a magenta color when heated to a particular temperature. The temperature for activating the dye of the magenta layer (114) is higher than the temperature for activating the dye of the yellow layer (112).

A second spacer layer (115) is disposed between the magenta color-forming layer (114) and the underlying cyan color-forming layer (116). The cyan color-forming layer (116) is also temperature-sensitive and will take on a cyan color when heated to a particular temperature. The temperature for activating the dye of the cyan layer (116) is higher than the temperature for activating the dye of the magenta layer (116). Under the cyan layer (116), an adhesive layer (117) may be employed to secure the layers above to the substrate (118).

When the medium (110) is used to form an image, the image is divided into color components, i.e., yellow, magenta and cyan. The medium (110) is the selectively heated in certain areas at a first temperature that will activate the dye of the yellow layer (112). Thus, the yellow color component of the image is formed in the yellow color-forming layer (112) by selectively heating that layer (112). This yellow component of the image is then fixed in a manner that will be described in detail below.

Next, the medium (110) is selectively heated at a second temperature that will activate the dye of the magenta layer (114) and form the magenta color component of the image in the magenta color-forming layer (114). Again, the magenta component of the image is then fixed.

Lastly, the medium (110) is selectively heated at a third temperature that will activate the dye of the cyan layer (116) and form the cyan color component of the image in the cyan color-forming layer (116). Because the cyan color component is the last to be formed, it is possible, but not necessary, to fix the cyan component of the image.

This process of forming an image on the thermally sensitive medium (110) can be performed by the system illustrated in FIG. 1. As shown, the system uses a radiant energy source, such as an optical pickup (104) that includes, for example, a laser (106) and an objective lens (105) that focuses the laser beam (108) from the laser (106) onto the thermally sensitive medium (110). In some examples, the laser is a 780 nm laser. The laser beam (108) is used to selectively heat the thermally sensitive medium (110) to activate the dye in the yellow layer (112) first and then in the magenta (114) and cyan (116) layers.

First, a processor (101) receives a signal (103) with the image data representing the image to be formed on the thermally sensitive medium (110). This signal (103) may convey the image already separated into the three color components or may convey a full color image which is separated into color components by the processor (101). The processor (101) then drives the laser (106) to selectively heat pixel regions on the thermally sensitive medium (110) in accordance with the color for that pixel. Each pixel of the image may require the activation of dye in one or more of the layers (112, 114, 116) to achieve the particular color shade for that pixel.

A media movement system (102) moves (109) the thermally sensitive medium (110) relative to the optical pickup (104) so that the laser beam (108) can be used to heat and form colored pixels over most, if not all, of the entire surface of the thermally sensitive medium (110). In some embodiments, a carriage (120) will also, or alternatively, move the optical pickup (104) and laser (106) relative to the thermally sensitive medium (110) so that the laser beam (108) can be used to heat and form colored pixels over the surface of the thermally sensitive medium (110).

At least the top, yellow color-forming layer (112) will include antenna molecules (100). An antenna molecule (100) absorbs radiant or light energy, for example, from the laser beam (108), and transforms the light energy into thermal energy or heat. Thus, as the laser beam (108) illuminates the thermally sensitive medium (110), the antenna molecules (100) in a region (119) of the yellow color-forming layer (112) receive the light from of the laser beam (108) and generate heat. Given enough time, this heat becomes sufficient to activate the yellow dye forming a yellow spot or pixel on the thermally sensitive medium (110). In this fashion, the thermally sensitive medium (110) and/or the optical pickup (104) are moved (109) relative to each other, and the laser (106) is selectively activated to form the yellow component of the image being printed on the thermally sensitive medium (110).

After the yellow component of the image has been formed in the yellow color-forming layer (112), the thermally sensitive medium (110) is irradiated with an ultraviolet light source (107) at a first wavelength (e.g., 420 nm). The ultraviolet radiation neutralizes the un-activated dye in the yellow color-forming layer (112) so that it will not then respond to heat and take on a yellow color. Thus, the yellow component of the image appears in the yellow color-forming layer (112), but subsequent heating will not cause further portions of the layer (112) to yellow. In this way, the yellow component of the image is fixed on the thermally sensitive medium (110). The wavelength used to fix the yellow component of the image will deactivate the un-activated dye in the yellow layer (112), but will not affect dye formation in the other layers (114, 116).

As used herein and in the appended claims, dye is "activated" when it has been heated sufficient to visually assume a particular color. Consequently, "un-activated" dye is dye that has not been heated and has not assumed the specified color. When a color-forming layer is selectively exposed, some of the dye in the layer is activated, while some dye remains un-activated, such that the color component of the image being formed appears in the pattern of activated and un-activated dye. "Neutralizing" dye means that the un-activated dye is rendered incapable of responding to the temperatures that would normally activate the dye.

Next, the process described above is then repeated for the magenta component of the image. Again, the laser (106) of the optical pickup (104) is scanned over the thermally sensitive medium (110) and/or the thermally sensitive medium (110) is moved under the optical pickup (104). The laser (106) is selectively activated to heat portions of the thermally sensitive medium (110) corresponding to the magenta component of the image.

The antenna molecules (100) in the yellow color-forming layer will again generate heat that will diffuse down to the magenta layer (114) below. This may be sufficient to selectively activate the magenta color-forming layer (114). Alternatively, the magenta color-forming layer (114) may also include antenna molecules (100) to help generate heat.

As indicated above, the magenta color-forming layer (114) is less temperature sensitive than the yellow color-forming layer (112). Consequently, the magenta color-forming layer (114) was not activated at the temperatures used previously to activate the yellow color-forming layer (112). Additionally, the relative movement of the thermally sensitive medium (110) and the optical pickup (104) can be slowed and/or the intensity of the laser beam (108) increased during printing of the magenta image component to allow the laser beam (108) to heat portions of the thermally sensitive medium (110) to a sufficient temperature to selectively activate the magenta color-forming layer (114).

After the magenta component of the image has been formed in the magenta color-forming layer (114), the thermally sensitive medium (110) is again irradiated with an ultraviolet light source (107). However, the ultraviolet light used is at a second wavelength (e.g., 365 nm) that neutralizes the un-activated dye in the magenta color-forming layer (114). Thus, the neutralized magenta dye will not then respond to heat and display the magenta color. Consequently, the magenta component of the image appears in the magenta color-forming layer (114), but subsequent heating will not cause further portions of the layer (114) to color. In this way, the magenta component of the image is fixed on the thermally sensitive medium (110).

After the magenta component of the image is formed and fixed, the process is repeated a final time for the cyan component of the image. Again, the laser (106) of the optical pickup (104) is scanned over the thermally sensitive medium (110) and/or the thermally sensitive medium (110) is moved under the optical pickup (104). The laser (106) is selectively activated to heat portions of the thermally sensitive medium (110) corresponding to the cyan component of the image.

The antenna molecules (100) in the yellow color-forming layer will again generate heat that will diffuse down to the magenta layer (114) and the cyan layer (116) below. This may be sufficient to selectively activate the cyan color-forming layer (116). Alternatively, either of both of the magenta color-forming layer (114) and the cyan color-forming layer (116) may also include antenna molecules (100) to help generate heat.

As indicated above, the cyan color-forming layer (114) is the least temperature sensitive layer. Consequently, the cyan color-forming layer (116) was not activated at the temperatures used previously to activate the yellow color-forming layer (112) or the magenta color-forming layer (114). Additionally, the relative movement of the thermally sensitive medium (110) and the optical pickup (104) will again be slowed and/or the intensity of the laser beam (108) increased during printing of the cyan image component to allow the laser beam (108) to heat portions of the thermally sensitive medium (110) to a sufficient temperature to selectively activate the cyan color-forming layer (116).

After the cyan component of the image has been formed in the cyan color-forming layer (116), the process of forming the desired image is essentially complete. It is not necessary to irradiate the thermally sensitive medium (110) with the ultraviolet light source (107) to fix the cyan component of the image because there will likely be no additional heating of the thermally sensitive medium (110) to temperatures that might further activate the remaining un-activated cyan dye in the cyan color-forming layer (116).

By way of example, the following dye compounds may be used: IR780 (Aldrich™ 42,531-1); IR1040 (Aldrich™ 40,513-2); IR783 (Aldrich™ 54,329-2); SynTec™ 9/1; SynTec™ 9/3; some metal complexes, such as dithiolane metal complexes and indoaniline metal complexes; Phthalocyanines or Naphthalocyanines (e.g., hexyl naphthalocyanine); and 800 NP (a proprietary dye available from Avecia™. The dye molecules may be dissolved in to the matrix of each dye layer (112, 114, 116) and/or may be encapsulated with an appropriately temperature-sensitive encapsulant used in each layer.

The processor (101) controls and coordinates the operation of the various components of the system, i.e., the radiant energy source, the media movement system (102), the carriage (120) and the ultraviolet light source (107). In this way, the medium (110) is moved relative to the radiant energy source in the right pattern and at the right speed to allow the laser (106) to write each successive color component of the image to the corresponding layer (112, 114, 116) of the medium (110), with the yellow and magenta components being fixed by the ultraviolet light source (107) after formation to allow for the formation of the subsequent color component(s). The resulting image may be a photo-quality image.

Figure 2:
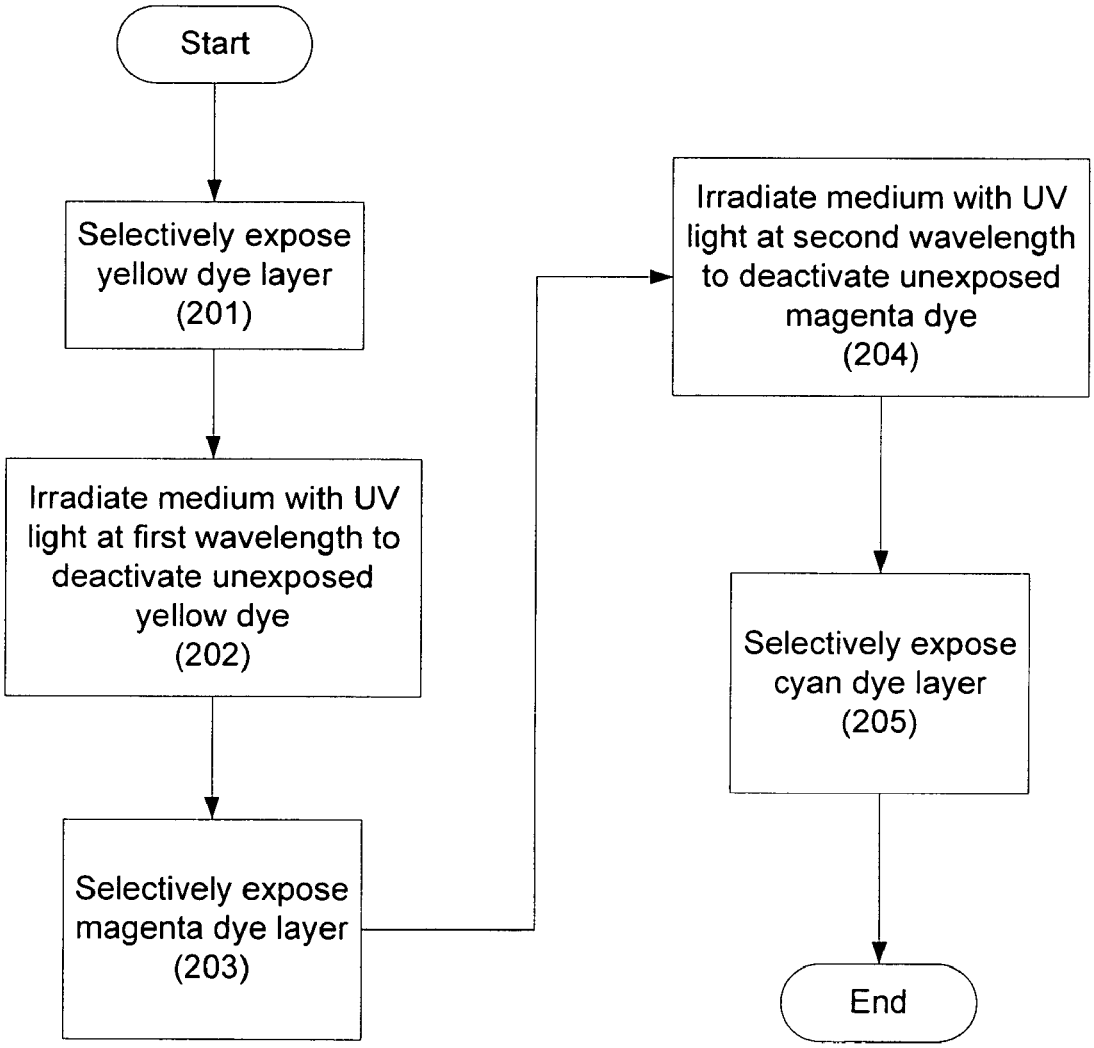
FIG. 2 is a flowchart illustrating an exemplary method of operating the system shown in FIG. 1.

FIG. 2 is a flowchart illustrating an exemplary method of operating the system shown in FIG. 1. As shown in FIG. 2, and as described above, the thermally sensitive medium is first selectively exposed to the light and consequent heat from the radiant energy source to write the yellow color component of the image being printed (step 201). Where sufficiently heated by the intense light of the radiant energy source, the yellow color-forming layer takes on a yellow color. By selectively heating the yellow color-forming layer, the yellow component of the image being printed is formed on the medium.

Next, the medium is irradiated with ultraviolet light at a wavelength that will neutralize the un-activated yellow dye in the yellow color-forming layer (step 202). It is not necessary to selectively expose the medium with the ultraviolet light. Rather, the entire medium can be exposed to the ultraviolet light at once and movement of the medium may not be necessary for this step.

The color activation and deactivation can be done consecutively in some embodiments if, for example, the deactivation light source (365 nm or 420 nm) is also a point source that trails the activation laser. Note also that the deactivation light source may be directed at previously printed tracks so that an insignificant portion of its light will be directed at unmarked tracks. This eliminates the possibility of destroying the color forming ability of tracks that have not yet passed under the laser.

Next, the thermally sensitive medium is again selectively exposed to the light and consequent heat from the radiant energy source to write the magenta color component of the image being printed (step 203). Where sufficiently heated by the intense light of the radiant energy source, the magenta color-forming layer takes on a magenta color. Thus, by selectively heating the magenta color-forming layer, the magenta component of the image being printed is formed on the medium. This will entail slower relative movement of the medium and the radiant energy source to allow the light from the radiant energy source to sufficiently heat the magenta color-forming layer at selected locations. Alternatively or additionally, the power of the light from the radiant energy source can be increased to reach the higher temperatures needed to activate lower color-forming layers.

Next, the medium is again irradiated with ultraviolet light at a second wavelength that will neutralize the un-activated magenta dye in the magenta color-forming layer (step 204). Again, it is not necessary to selectively expose the medium with the ultraviolet light. Rather, the entire medium can be exposed to the ultraviolet light at once and movement of the medium may not been necessary for this step.

Lastly, the thermally sensitive medium is again selectively exposed to the light and consequent heat from the radiant energy source to write the cyan color component of the image being printed (step 205). Where sufficiently heated by the intense light of the radiant energy source, the cyan color-forming layer takes on a cyan color. By selectively heating the cyan color-forming layer, the cyan component of the image being printed is formed on the medium. This will again entail slower relative movement of the medium and the radiant energy source and/or an increase in laser power to allow the light from the optical pickup to sufficiently heat the cyan color-forming layer at selected locations. As indicated above, each successive layer (yellow, magenta, and cyan) is less temperature-sensitive than the preceding layer, i.e., requires a higher temperature to activate the dye.

Optical discs have fast become an industry standard for data storage in the fields of computers, video, and music. Optical discs include, but are not limited to, compact discs (CDs), digital video (or versatile) discs (DVDs), and game system discs in a variety of formats. Commercially produced optical discs typically have digital data recorded on one side of the disc and a visual display, or a label printed on the other side of the disc.

As optical technology has advanced, writeable and rewritable optical discs as well as equipment for writing onto the discs have become reasonably priced within the grasp of ordinary consumers. Thus, many consumers currently have the ability to burn data onto optical discs with home or office computers that have optical disc drives. For example, consumers may, in some instances, purchase CD or DVD data from a website on the Internet and burn the data onto their own CD or DVD. If the data is purchased in this way, it will be written to a blank, unmarked disc on which the user may very much want to form a label.

Consequently, many consumers desire to be able to create a display or label on a non-data side of an optical disc on which data has or will be stored. Thus, some of the applications of the system described above will include stacking temperature sensitive color-forming layers on a side of an optical disc to create a thermally sensitive medium on an optical disc that can be used to form a visual display or label on one side of the disc.

The data on an optical disc is read from the disc using an optical pickup. Laser light from the optical pickup is typically focused on the optical disc and, depending on the data written to the disc, is reflected or not reflected at each point on the disc. In this way, as the disc rotates beneath the optical pickup and the optical pickup moves radially over the disc, digital, binary data can be written to and read from an optical disc.

FIG. 3 is an illustration of an optical disc player/writer (131) designed to retrieve data from an optical disc (130). The optical disc (130) may be, for example, a CD, DVD, game disc or other disc. The player (131) may be designed only to read data from the optical disc (130) or may also be designed to write data to the disc (130).

The optical disc player shown in FIG. 3 also incorporates the system shown in FIG. 1 according to principles described herein. The optical pickup of the disc player (131) can be used as the radiant energy source (104, FIG. 1) in the system for printing an image on a thermally sensitive medium that is formed on the optical disc (130). As indicated above, the substrate (118, FIG. 1) of a thermally sensitive medium may be an optical disc.

The spindle (132) that rotates the disc (130) may function as the medium movement system (102, FIG. 1) described above. Additionally, the player (131) will include a carriage (120) for translating the optical pickup (114) radially over the disc (130).

The optical disc player (131) also includes a UV light source (107). The UV light source (107) can irradiate the disc (130) between the printing of successive color components to deactivate unused dye as described above. The optical disc player (131) also includes a processor (101) similar to that described above for controlling the various components described to write images to the thermally sensitive medium disposed on the optical disc (130).

Consequently, the user can place the disc (130) in the player (131) with a data side presented to the optical pickup (114) and then read data from or write data to the disc (130). The user can then flip the disc (130) to present a thermally sensitive medium side of the disc (130) to the optical pickup (114). The player (131) can then be used to print an image on the thermally sensitive medium of the disc (130).

FIG. 4 is an illustration of an optical disc drive reader/writer incorporating the system shown in FIG. 1 according to principles described herein. As shown in FIG. 4, in addition to a stand-alone player/writer, the system of FIG. 1 can be incorporated into an optical disc drive (140) that is a component of a larger system, for example, a personal computer, laptop computer, server, etc.

Figure 5:
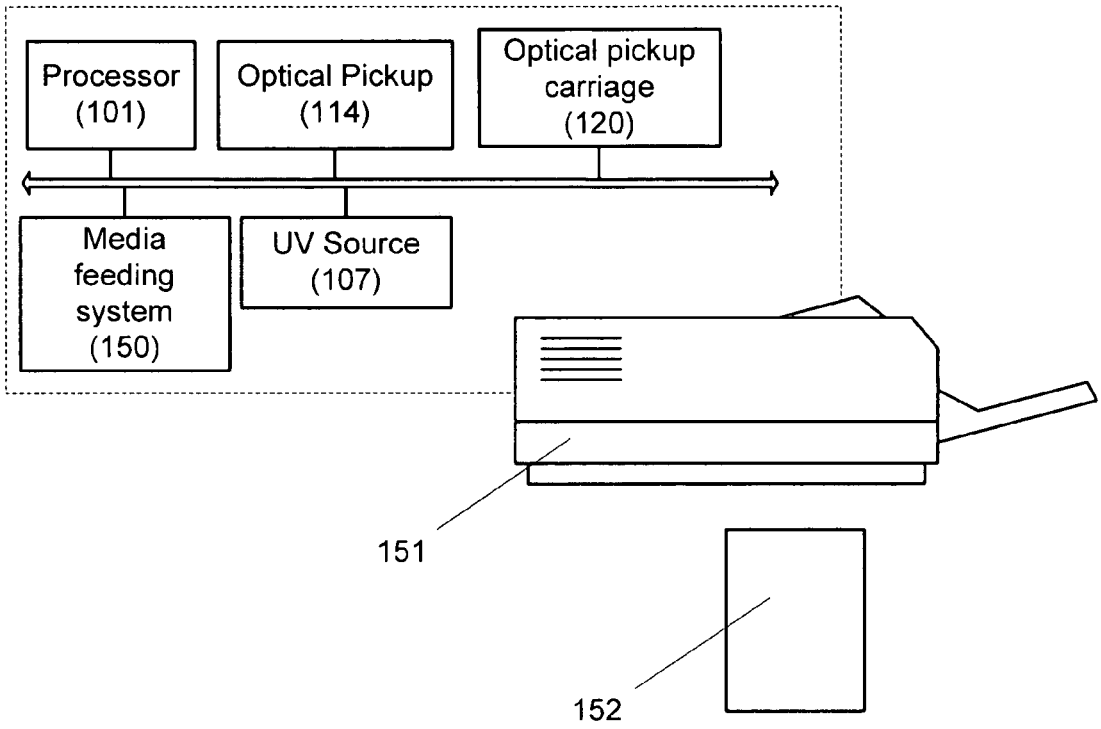
FIG. 5 is an illustration of a printer or printing device incorporating the system shown in FIG. 1 according to principles described herein.

FIG. 5 is an illustration of a printer or printing device incorporating the system shown in FIG. 1 according to principles described herein. As shown in FIG. 5, a printing device (151) may include a processor (101), radiant energy source (114) and ultraviolet light source (107) as described above.

Sheets of paper or other media (152) are prepared for the printing device (151) by placing the various color-forming layers of temperature-activated dye on the substrate of the paper (152) to form a thermally sensitive medium. The medium (152) is them moved through the printing device (151) and relative to the radiant energy source (114) by a media feeding system (150). The carriage (120) also moves the radiant energy source (114) relative to the medium (152).

Using the methods described above, the printing device (151) then forms a desired image on the thermally sensitive medium (152). The thermally sensitive printing system described herein can thus be adapted for a wide variety of applications.

The preceding description has been presented only to illustrate and describe embodiments of the invention. It is not intended to be exhaustive or to limit the invention to any precise form disclosed. Many modifications and variations are possible in light of the above teaching. It is intended that the scope of the invention be defined by the following claims.

What is claimed is:

1. A thermally sensitive medium comprising:

multiple layers of temperature-activated dye; and antenna molecules disposed with said temperature-activated dye for converting radiant energy into thermal energy;

wherein:

in said multiple layers of temperature-activated dye, each layer comprises temperature-activated dye of a different color; and said antenna molecules are disposed in at least one of said multiple layers of dye.

2. The medium of claim 1, wherein each layer of dye is sensitive to, and assumes a specific color at, a different temperature.

3. The medium of claim 1, wherein said multiple layers of dyes comprising:

a layer of yellow temperature-activated dye;

a layer of magenta temperature-activated dye; and a layer of cyan temperature-activated dye.

4. The medium of claim 1, further comprising wherein said antenna molecules are disposed only with an outer-most layer of temperature-activated dye such that as said antenna molecules heat in response to radiant energy, the heat diffuses through to underlying layers of temperature-activated dye.

5. The medium of claim 1, wherein said antenna molecules are disposed in each of said multiple layers of dyes.

6. A thermally sensitive medium comprising:

a plurality of layers of temperature-activated dye; and antenna molecules disposed with said layers of temperature-activated dye for convening radiant energy into thermal energy;

wherein each successive layer of dye from a surface of said medium is less temperature sensitive than a preceding layer of dye.

7. A thermally sensitive medium comprising:

at least one layer of temperature-activated dye; and antenna molecules disposed in said layer of temperature-activated dye for converting radiant energy into thermal energy;

wherein said at least one layer of dye is disposed on a substrate with an adhesive layer.

8. A thermally sensitive medium comprising:

a plurality of layers of temperature-activated dye; and antenna molecules disposed with said layers of temperature-activated dye for converting radiant energy into thermal energy; and spacer layers between said layers of dye.

9. A system for forming an image on a thermally sensitive medium comprising:

a printer comprising a media feeding system for feeding sheets of said thermally sensitive medium through said printer for printing;

a radiant energy source in said printer for selectively heating portions of said thermally sensitive medium to activate temperature-activated dyes of said medium; and antenna molecules disposed in at least one layer of dye on said medium, said molecules converting visible light energy from said radiant energy source into thermal energy.

10. The system of claim 9, further comprising a carriage for moving said radiant energy source relative to said medium.

11. The system of claim 9, wherein said radiant energy source comprises an optical pickup.

12. The system of claim 9, wherein said thermally sensitive medium comprises thermo-autochrome paper.

13. A system for forming an image on a thermally sensitive medium comprising:

a radiant energy source for selectively heating portions of said thermally sensitive medium to activate temperature-activated dyes of said medium; and a carriage for moving said radiant energy source relative to said medium;

wherein a speed of said carriage is slowed when said radiant energy source is selectively heating a deeper layer of temperature-activated dye on said medium.

14. The system of claim 13, wherein said radiant energy course is a laser, said system further comprising a deactivation light source which is a point source that trails said laser to neutralize un-activated dye in a said layer of temperature-activated dye.

15. A system for forming an image on a thermally sensitive medium comprising:

a radiant energy source for selectively heating portions of said thermally sensitive medium to activate temperature-activated dyes of said medium; and a media movement system for moving said medium relative to said radiant energy source;

wherein a speed of said media movement system is slowed when said radiant energy source is selectively heating a layer of temperature-activated dye through one or more other layers on said medium.

16. A system for forming an image on a thermally sensitive medium comprising:

a radiant energy source for selectively heating portions of said thermally sensitive medium to activate temperature-activated dyes of said medium;

wherein a power of said radiant energy source is increased for selectively heating a layer of temperature-activated dye through one or more other layers on said medium.

17. A system for forming an image on a thermally sensitive medium comprising:

a printer comprising a media feeding system for feeding sheets of said thermally sensitive medium through said printer for printing;

a radiant energy source in said printer for selectively heating portions of said thermally sensitive medium to activate temperature-activated dyes of said medium;

antenna molecules disposed in at least one layer of dye on said medium, said molecules converting light energy from said radiant energy source into thermal energy; and an ultraviolet light source for irradiating said medium to selectively neutralize said temperature-activated dyes.

18. A system for forming an image on a thermally sensitive medium comprising:

a radiant energy source for selectively heating portions of said thermally sensitive medium to activate temperature-activated dyes of said medium;

antenna molecules disposed in at least one layer of dye on said medium, said molecules converting light energy from said radiant energy source into thermal energy; and an ultraviolet light source for irradiating said medium to selectively neutralize said temperature-activated dyes;

wherein said ultraviolet light source selectively outputs ultraviolet light of at least two separate wavelengths corresponding to wavelengths effective to neutralize temperature-activated dye in different color-forming layers of said medium.

19. A method of forming an image on a thermally sensitive medium comprising multiple layers of temperature-activated dyes, said method comprising:

selectively heating portions of each of said layers of temperature-activated dyes with a light source to form said image; and heating said temperature-activated dyes with antenna molecules disposed in at least one of said layers of dye, wherein said antenna molecules convert light energy from said light source into heat.

20. The method of claim 19, further comprising successively forming a particular color component of said image in each of said layers of dye.

21. The method of claim 19, wherein said selectively heating portions of each of said layers of dye comprises moving said medium relative to said light source.

22. The method of claim 19, further comprising irradiating said medium with ultraviolet light after forming a color component of said image in a particular layer of dye to neutralize un-activated dye in that Layer.

23. The method of claim 19, wherein said medium comprises a yellow color-forming layer disposed over a magenta color-forming layer disposed over a cyan color-forming layer, with each layer being less temperature sensitive than a preceding layer.

24. The method of claim 23, further comprising selectively heating said yellow color-forming layer with said light source to form a yellow component of said image in said yellow color-forming layer.

25. The method of claim 24, wherein said yellow color-forming layer is irradiated with ultraviolet light at a first wavelength to neutralize un-activated dye in said yellow color-forming layer.

26. The method of claim 25, further comprising selectively heating said magenta color-forming layer with said light source to form a magenta component of said image in said magenta color-forming layer.

27. The method of claim 26, wherein said magenta color-forming layer is irradiated with ultraviolet light at a first wavelength to neutralize un-activated dye in said magenta color-forming layer.

28. The method of claim 27, further comprising selectively heating said cyan color-forming layer with said light source to form a cyan component of said image in said cyan color-forming layer.

29. A method of forming an image on a thermally sensitive medium comprising multiple layers of temperature-activated dyes, said method comprising:

selectively heating portions of each of said layers of temperature-activated dyes with a light source to form said image; and moving said medium at a different speed for selective heating of each of said layers of temperature-activated dye.

30. A method of forming an image on a thermally sensitive medium comprising multiple layers of temperature-activated dyes, said method comprising:

selectively heating portions of each of said layers of temperature-activated dyes with a light source to form said image;

wherein selectively heating portions of each of said layers of dye comprises adjusting a power of said light source based on a depth of a layer of temperature-activated dye being selectively heated.

31. An optical disc player or drive for forming an image on a thermally sensitive medium disposed on an optical disc, said drive comprising:

a radiant energy source for selectively heating portions of said thermally sensitive medium to activate temperature-activated dyes of said medium; and a carriage for moving said radiant energy source relative to said medium, wherein a speed of said carriage is adjusted based on a depth of a layer of temperature-activate dye being activated by said radiant energy source.

32. The player or drive of claim 31, further comprising an ultraviolet light source for irradiating said medium to selectively neutralize said temperature-activated dyes;

wherein said ultraviolet light source selectively outputs ultraviolet light of at least two separate wavelengths corresponding to wavelengths effective to neutralize temperature-activated dye in different color-forming layers of said medium.

33. An optical disc player or drive for forming an image on a thermally sensitive medium disposed on an optical disc, said drive comprising:

a radiant energy source for selectively heating portions of said thermally sensitive medium to activate temperature-activated dyes of said medium; and a spindle for rotating said medium relative to said radiant energy source, wherein a speed of said spindle is adjusted based on a depth of a layer of temperature-activate dye being activated by said radiant energy source.

34. The player or drive of claim 33, further comprising an ultraviolet light source for irradiating said medium to selectively neutralize said temperature-activated dyes;

wherein said ultraviolet light source selectively outputs ultraviolet light of at least two separate wavelengths corresponding to wavelengths effective to neutralize temperature-activated dye in different color-forming layers of said medium.

35. A printer for forming an image on a thermally sensitive medium, said printer comprising:

a radiant energy source for selectively heating portions of said thermally sensitive medium by irradiating antenna molecules in said medium which then heat upon receipt of radiant energy to activate temperature-activated dyes of said medium;

a media feeding system for moving sheets of said medium relative to said radiant energy source; and a carriage for moving said radiant energy source relative to said medium, wherein a speed of said carriage is adjusted based on a depth of a layer of temperature-activate dye being activated.

36. A printer for forming an image on a thermally sensitive medium, said printer comprising:

a radiant energy source for selectively heating portions of said thermally sensitive medium by irradiating antenna molecules in said medium which then heat upon receipt of radiant energy to activate temperature-activated dyes of said medium; and a media feeding system for moving sheets of said medium relative to said radiant energy source;

wherein a speed of said media feeding system is adjusted based on a depth of a layer of temperature-activate dye being activated by said radiant energy source.

37. A printer for forming an image on a thermally sensitive medium, said printer comprising:

a radiant energy source for selectively heating portions of said thermally sensitive medium by irradiating antenna molecules in said medium which then heat upon receipt of radiant energy to activate temperature-activated dyes of said medium;

a media feeding system for moving sheets of said medium relative to said radiant energy source; and an ultraviolet light source for irradiating said medium to selectively neutralize said temperature-activated dyes;

wherein said ultraviolet light source selectively outputs ultraviolet light of at least two separate wavelengths corresponding to wavelengths effective to neutralize temperature-activated dye in different color-forming layers of said medium.

* * * * *

UNITED STATES PATENT AND TRADEMARK OFFICE

CERTIFICATE OF CORRECTION

PATENT NO. : 7,477,274 B2
APPLICATION NO. : 11/021577
DATED : January 13, 2009
INVENTOR(S) : Andrew L. Van Brocklin et al.

It is certified that error appears in the above-identified patent and that said Letters Patent is hereby corrected as shown below:

In column 8, line 48, in Claim 6, delete "convening" and insert -- converting --, therefor.

In column 9, line 29, in Claim 14, delete "course" and insert -- source --, therefor.

In column 10, line 33, in Claim 22, delete "Layer" and insert -- layer --, therefor.

Signed and Sealed this

Eighteenth Day of August, 2009

David J. Kappos

David J. Kappos
*Director of the United States Patent and Trademark Office*